United States Patent [19]

Sherrick

[11] Patent Number: 5,022,584

[45] Date of Patent: Jun. 11, 1991

[54] RAIL-FASTENING FOR RAILS

[75] Inventor: James W. Sherrick, Edinboro, Pa.

[73] Assignee: Lord Corporation, Erie, Pa.

[21] Appl. No.: 289,952

[22] Filed: Dec. 27, 1988

[51] Int. Cl.[5] ..... E01B 9/38

[52] U.S. Cl. ..... 238/282; 238/283; 238/331; 238/338; 238/346

[58] Field of Search ..... 238/310, 331, 332, 338, 238/341, 342, 346, 377, 282, 283, 297, 264, 315, 287

[56] References Cited

U.S. PATENT DOCUMENTS

| | | | |
|---|---|---|---|
| 793,054 | 6/1905 | Clough | 238/346 |
| 862,472 | 8/1907 | Hamilton | 238/304 |
| 1,101,661 | 6/1914 | Richardson | 238/346 |
| 1,126,530 | 1/1915 | Liebmann | 238/346 |
| 1,150,323 | 8/1915 | Amundson | 238/282 |
| 1,559,003 | 5/1925 | Powell | 238/282 |
| 2,579,373 | 12/1951 | Edee | 238/282 |
| 3,576,293 | 4/1971 | Landis et al. | 238/287 |
| 3,784,097 | 1/1974 | Landis | 238/310 |
| 3,858,804 | 1/1975 | Hixson | 238/264 |
| 4,141,500 | 2/1979 | Gragnani | 238/304 |
| 4,325,510 | 4/1982 | Sherrick | 238/282 |

FOREIGN PATENT DOCUMENTS

| | | | |
|---|---|---|---|
| 0489656 | 10/1975 | Australia | 238/310 |
| 0560028 | 7/1958 | Canada | 238/283 |
| 0616124 | 6/1935 | Fed. Rep. of Germany | 238/331 |
| 2292072 | 6/1976 | France | 238/338 |
| 0881898 | 11/1961 | United Kingdom | 238/331 |

OTHER PUBLICATIONS

"Direct Fixation Rail Fasteners", Lord Corporation Brochure No. DS-7201b, 1984.

*Primary Examiner*—Douglas C. Butler
*Assistant Examiner*—Mark T. Le
*Attorney, Agent, or Firm*—Haynes & Boone

[57] ABSTRACT

A rail fastener for fastening rails to a support structure, particularly adapted for use in switches, crossovers, frogs and the like where a track plate must support a pair of closely spaced or nonparallel rails. The rail fastening includes a rigid track plate to which the rail is adjacent and two fastener pads laterally spaced on the track plate and disposed between the track plate and the support structure. Each fastener pad has a rigid member and a resilient member bonded together and two pins to join the elastomeric member to the track plate.

16 Claims, 4 Drawing Sheets

RAIL-FASTENING FOR RAILS

FIELD OF THE INVENTION

The present invention relates to systems for fastening railroad rails to an underlying support structure, and particularly to such fastening systems for special trackwork such as switches, crossovers and guardrails in rapid transit rail systems.

BACKGROUND OF THE INVENTION

In the past, fasteners for attaching railroad rails to support structures have included a track plate secured to the bottom of each rail by suitable clamping devices, together with an underlying layer of elastomeric material abutting the support structure directly or abutting a second underlying plate which rests on the support structure. Ordinarily, the track and underlying plates on which the rail rests are secured to the support structure by bolts or other clamping arrangements. In certain clamping arrangements of this sort, as exemplified by U.S. Pat. No. 3,784,097, the clamps take the form of clips having a load bearing surface which mate to and overlie the lower rail flange and are secured to an underlying plate by means of bolts. Serrations may be provided in the top surface of the track plate for receiving a projection of the clip to permit lateral adjustment of the clip while limiting horizontal or sideways movement of the clip and rail. Such fasteners are limited to attaching rails that are perpendicular to the longitudinal axis of the track plate or are spaced apart to accommodate separate fasteners for each rail. Sufficient distance between the rails is required to accommodate the track plate of the individual fasteners.

However, rails are not always perpendicular to the track plate and in other cases, the rails are spaced too close together to allow for separate fasteners for each rail. Furthermore, two nonparallel rails may require support on one track plate. Such rails are generally found in systems used to switch trains from one set of rails to another including crossings, switches, frogs and the like. Conventional fasteners may be used in switches on converging rails until the rails are too close together to allow for individual fasteners to be placed under each rail.

Although the fasteners as described are adjustable along the longitudinal axis of the track plate, they fail to provide angular adjustment for nonperpendicular positioning of the rail to the track plate. That is, if other than a substantially perpendicular relationship exists between the rail and the track plate, the load bearing surface of the clips will not fully engage the bottom flange of the rail. In other cases where the rails are spaced too close together such that the usual rail fasteners can not be used for each rail. Hence it is desirous to have a rail fastener that can accommodate lateral and angular adjustments as well as close spacing of rails.

A commercially available product overcoming some of the above described problems is an adjustable special track fastener sold by Lord Corporation, assignee of the present patent. The special track fastener includes a long flat rectangular track plate for attachment to the flanges of more than one rail and has an elastomeric member bonded the length of the track plate on the side opposite to the rail contact side for isolating and damping vibration of the track fastener. Combination of the long track plate and elastomeric member allows for positioning the plurality of rails along the longitudinal length of the track plate. Vertical serrations extend along each of the longitudinal edges of the track plate and are adapted to cooperate with fastener assemblies for securing the plurality of rails to the track plate. The fastener assemblies include a clamping member overlying the flange of each rail and a threaded nut having mating vertical serrations thereon engagable with the serrations along the longitudinal edges of the track plate. The clamping member overlies the nut and has a load bearing surface engagable with the flange of the associated rail. A bolt extends through the clamping member and is threaded into the nut for securing the clamping member to the nut while securing each rail against horizontal movement.

The fastener assembly may be located or adjusted along the longitudinal length of the track plate by virtue of the mating of the vertical serrations of the nut and the track plate. By virtue of the fact that the clamping member may rotate above the aforesaid bolt, it can be used in positively engage the rail along its length regardless of the angular attitude of the rail with respect to the plate. Such rotation provides angular adjustment of the clamping member to positively engage the rail along its length at non-perpendicular displacement of the rail with respect to the track plate.

Furthermore, the clamping member of the fastener assembly has elongated bores there through for the bolts to accommodate the varying distances between the bolts resultant from the angular adjustment of the clamping member. The distance between the bolts is shortest when the rail is perpendicular to the track plate and the distance increases with the nonperpendicularity of the rail.

While the described special trackwork fastener satisfactorily fastens closely spaced or nonparallel rails, hereinafter referred to as special rails, problems have arisen in using the fastener. One problem area is the adaptation of the special trackwork fastener to various separation widths between the rails. As one can imagine, widths between the rails will vary based on the point of convergence of the rails. Such separation widths may vary from about 1 inch to about 12 inches. Using a long special trackwork fastener for a short separation results in much of the special fastener being unused. Varying the length of the special trackwork fastener requires manufacturing using various molds corresponding to the length of the fasteners.

The resiliency properties of the special trackwork fastener are less desirable than the regular single pad under a single rail. Bonding of rubber to the full length of the track plate results in a very stiff fastener, increasing the spring rate of the elastomeric member underneath the rail and decreasing the flexibility of the fastener. Also, bonding of the rubber to the full length of the track plate is more expensive and difficult than for single pads. Various costly large molds are required to make the special fasteners. Serrations along the longitudinal edges of the track plate also increase the cost of the fastener.

The elastomer member of the aforesaid special trackwork fastener may require replacement after a period of time due to normal wear or upon failure. Replacement of the elastomeric member of the special trackwork fastener as described requires replacement of the entire fastener even though a limited portion of the fastener needs replacement. In summary, although the special trackwork fastener is capable of fastening special rails, various undesirable features are inherent in the product.

SUMMARY OF THE INVENTION

With the foregoing in mind, a primary object of the present invention is to provide an improved rail fastener particularly suited for connecting special trackwork such as switches, crossovers and guardrails (hereinafter referred to as special rails) to a support structure.

Another object of the present invention is to provide a novel rail fastener for connecting special rails to a support structure having an individual elastomer member disposed between the rail and the support structure.

A further object of the present invention is to provide a novel rail fastener for connecting special rails to a support structure that is readily adaptable to various rail spacing and angles.

A further object of the present invention is to provide a novel rail fastener for connecting special rails to a support structure having stiffness properties similar to those of a single pad arrangement.

A further object of the present invention is to provide a novel rail fastener for connecting special rails to a support structure that is easier and less expensive to manufacture than the existing special trackwork fastener designs.

A further object of the present invention is to provide a novel rail fastener for connecting special rails to a support structure that is easily repairable when the elastomeric member requires replacement.

It is a feature of this invention to have a fastener pad affixed to a track plate beneath each rail such that the fastener pad may be adjusted along the length of the track plate to accommodate for various spacings of the special rails and may be adjusted to accommodate non-perpendicular orientation of the rail to the track plate.

It is another feature of the invention to have suitable stiffness properties disposable under each special rail.

It is another feature of the invention to have a special trackwork fastener having easily replaceable elastomeric members.

It is an advantage of this invention that the special trackwork fastener is adaptable to accommodate various spacings and angles of special rails while having desirous stiffness properties and are easily replaceable.

It is an advantage of this invention that the rail fastener can be manufactured by using only one size mold similar to the mold size of regular fasteners to make the fastener pads that are affixed to the rigid track plate.

More specifically, in the present invention a rail fastener for fastening special rails to a support structure is described having a rigid track plate and a plurality of adjustably spaced discrete fastener pads joined to the track plate. Each of the fastener pads have a rigid member, a means to join the fastener pad to the track plate and an elastomeric member affixed to the rigid member for isolating vibrations. The fastener pads are disposed along the track plate in underlying relation to respective rails. The rigid member is generally disposed intermediate of the track plate and the resilient member. The rail is secured to the track plate by a means providing for lateral and angular adjustments of the track plate to the rails.

BRIEF DESCRIPTION OF THE DRAWINGS

The foregoing and other objects, features and advantages of the present invention should become apparent from the following description of the preferred embodiment when taken in conjunction with the accompanying drawings in which.

DESCRIPTION OF THE PREFERRED EMBODIMENT

Figure 1:
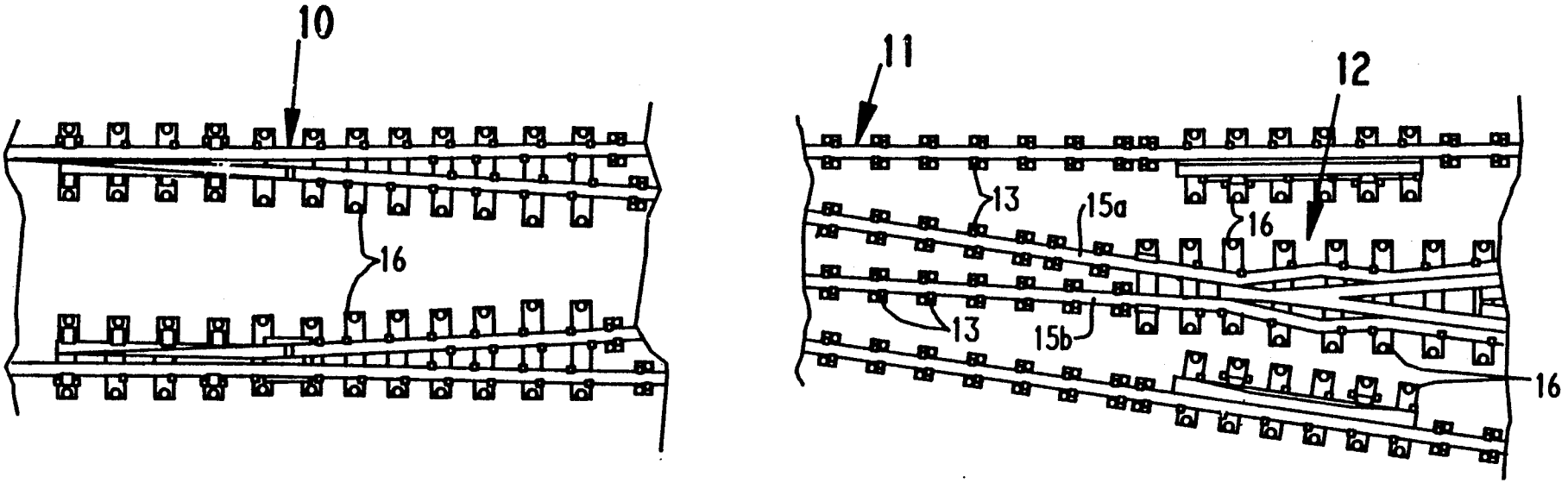
FIG. 1 is a top or plan view of an example of a track installation with which the present invention may be employed.

Referring now to the drawings, FIG. 1 shows a typical track installation with which the present invention may be used. It includes a switch section 10, a straight rail section 11 and a frog section 12. In the straight rail section 11, the rails are secured to underlying support structure such as concrete, by fasteners 13 which include an upper plate secured to the rails by suitable laterally adjustable clamping devices. Ordinarily, the fasteners 13 are provided with an underlying elastomer layer which abuts the underlying support surface directly or abuts a second underlying plate which rests on the support surface. Such fasteners are suitably used for straight sections of rails wherein the fastener and components thereof are square with the flange of the rail and can be used for converging rails at frogs or switches wherein the rails are sufficiently spaced to accommodate separate fasteners for each rail. Typical fasteners for rapid transit systems of this type are described in U.S. Pat. No. 3,576,293.

In the switch section 10 and the frog section 12, however, it will be appreciated that there are areas where two rails 15*a*, 15*b* converge or are located close together wherein single fasteners 13 cannot be located under individual rails 15*a*, 15*b*. Rather, rail fasteners 16 according to the present invention extending under closely adjoining rails are used for this purpose. Rail fasteners 16 include a rigid track plate spanning at least two rails, a plurality of adjustably spaced, discrete fastener pads, each joined to the track plate in an underlying relation to respective rails, and a means to join each rail to the track plate.

Figure 4:
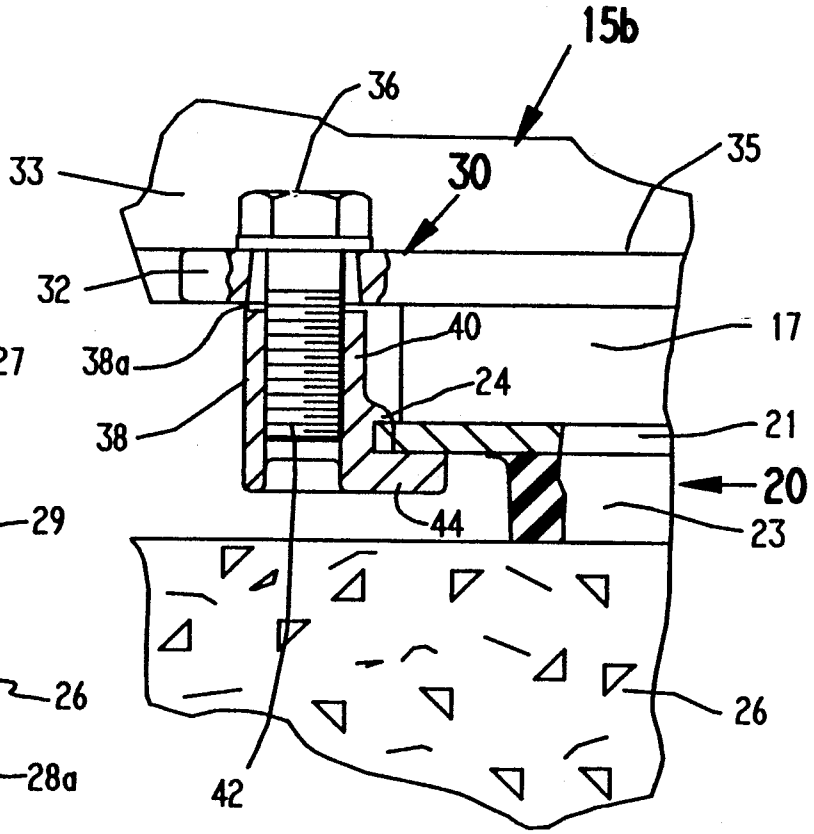
FIG. 4 is a partial cross-sectional view of the rail fastener taken substantially along the line 4—4 of FIG. 3.
Figure 3:
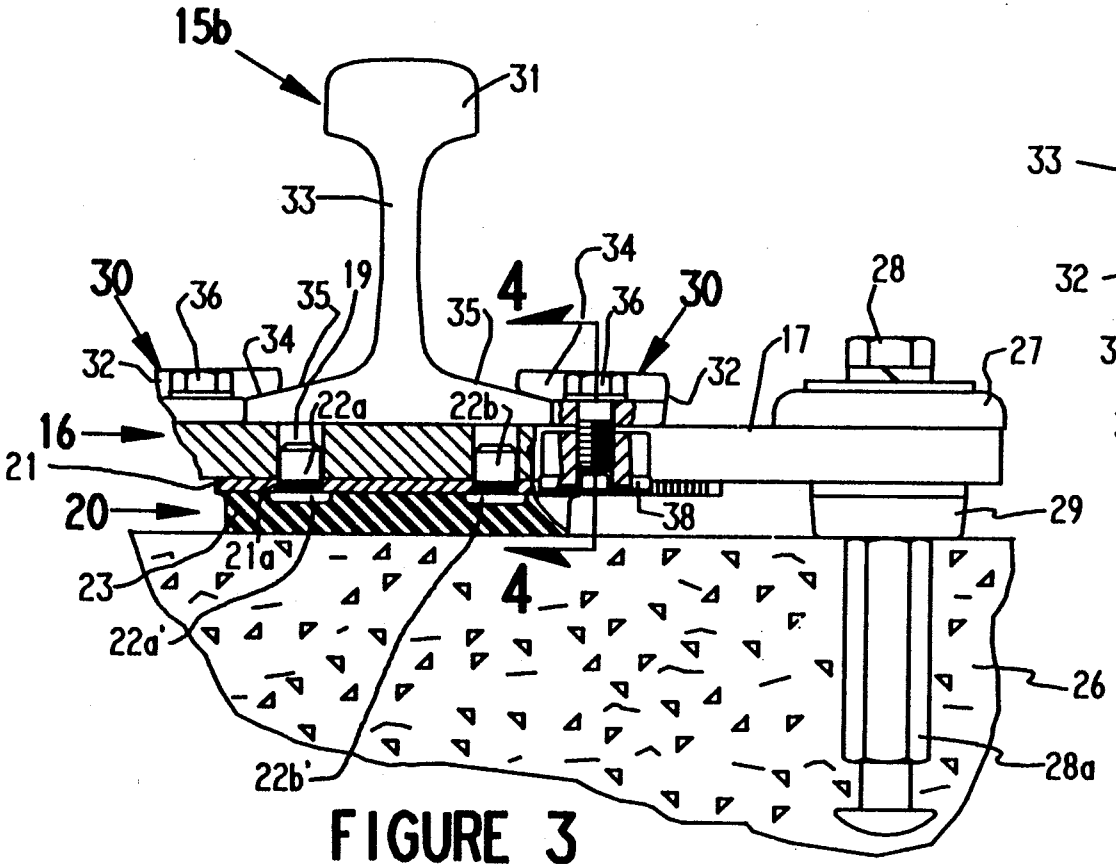
FIG. 3 is a partial cross-sectional view of FIG. 2 showing the track plate and a fastener pad disposed underneath the rail.
Figure 2:
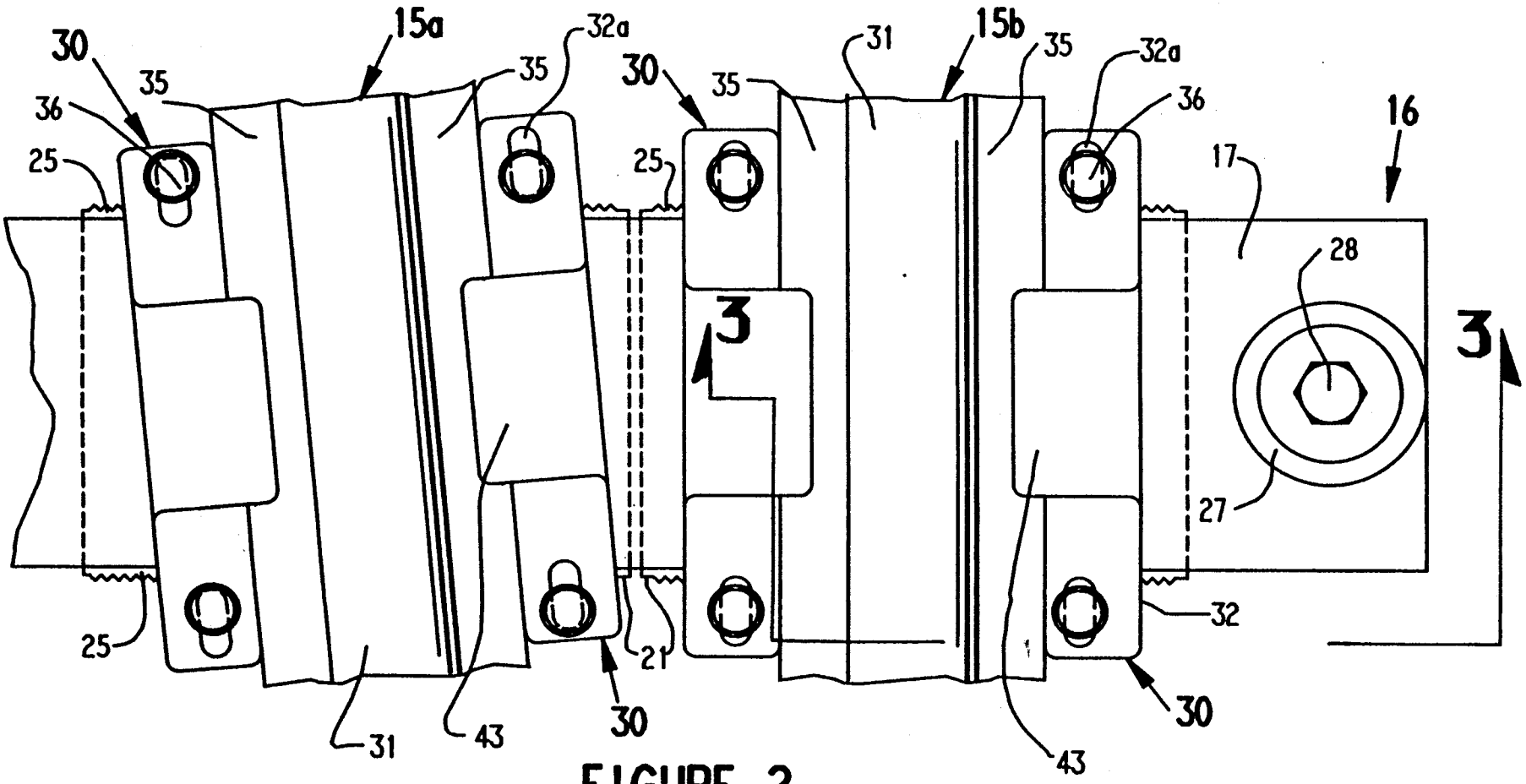
FIG. 2 is a top view of one embodiment of the invention showing two nonparallel rails fastened with clamping members to the track plate.

One embodiment of the present invention is shown in FIGS. 2–4. In particular, FIG. 2 shows the orientation of two rails 15*a*, 15*b* to the rail fastener 16. The two rails 15*a*, 15*b* are in close proximity as would be found in a switch section 10. Rail 15*b* extends at right angles to the rail fastener 16 whereas rail 15*a* is not parallel to rail 15*b*, being disposed at an angle of about 10° from a line perpendicular to the rail fastener 16. Such angle displacements may range up to about 20° from a line perpendicular to the rail fastener 16. Each rail 15*a*, 15*b* has an upper portion 31, web 33 and a flange 35 of which the upper portion 31 and flange 35 are shown in FIG. 2 and the web 33 is intermediate thereof.

As best seen in FIG. 3, the rail fastener 16 has a rigid track plate 17, a fastener pad 20 removably secured to the rigid track plate 17 and a fastener assembly 30 to secure the rail 15*a* to track plate 17. The rigid track plate 17 is a substantially flat elongate rectangular steel plate extending under and beyond the flanges 35 of both rails 15*a*, 15*b*. Located near each longitudinal end of the track plate 17, (one shown in FIGS. 2 and 3) is a bolt 28 and clamp 27 to secure the track plate 17 to the support structure 26 preventing undesirable lateral, longitudinal or vertical movement thereof. As shown in FIG. 3, the support structure 26 is concrete. A mating member 28*a* to the bolt 28 is secured in the support structure 26. The bolt 28 extends through an orifice in the clamp 27, an orifice in the track plate 17 and an orifice in a fastener pad 29 disposed between the track plate 17 and support structure 26 and is threadedly engaged with the mating member 28*a*. Clamp 27 and elastomer member 29 allow the track plate 17 to deflect in response to applied forces thereby reducing vibration and noise. Furthermore, a series of orifices 19 extend through and are located along the longitudinal axis of the plate 17 for joining the elastomeric member 23 to the top plate 17.

Each fastener pad 20 is an integral unit made up of a flat rectangular rigid steel plate member 21, a pair of steel pins 22*a*, 22*b* and a resilient member 23 affixed to the rigid member 21. The rigid member 21 has an upper surface mating against the bottom of the track plate 17 when assembled, and is sufficiently long to extend beyond the two longitudinal sides of the track plate 17 as shown in FIGS. 2 and 4. The opposite longitudinal edges of the rigid member 21 are provided with vertical serrations 25 along substantially their entire length as shown in FIG. 2. These serrations cooperate with fastener assemblies 30 to secure each rail 15*a*, 15*b* to the rail fastener 16. See FIG. 4. Orifices 21*a* extend through rigid member 21, spaced from each other and sized to mate with the orifices 19 of the top plate 17. Corresponding pins 22*a*, 22*b* extend through the respective orifices 21*a* and fit into the aligned orifice 19 of the top plate 17. Each pin 22*a*, 22*b* has a head portion 22*a*', 22*b*' which abuts the flat surface of the rigid plate 21. The pins 22*a*, 22*b* are assembled in the respective orifices 21*a* prior to the bonding of the resilient pad to the rigid member 21.

The resilient member 23 is made of elastomer suitable to isolate and dampen vibrations as well as to electrically insulate each rail 15*a*, 15*b* which may carry electrical signals, from ground. As is well known, the elastomer section allows the track plate 17 to deflect in response to force applied to the rail 15*a*, 15*b*, which reduces vibration and noise. The pad 23 is bonded to the rigid members 21 by a suitable elastomer to metal adhesive. An outer peripheral lip of the rigid plates extends beyond the resilient member 23 to provide a surface area to clamp the fastener pad 20.

According to the present invention, each rail 15*a*, 15*b* is adjustably secured to the rail fastener 16 at the desired angular and lateral relationship by the fastener assemblies 30. Referring to FIGS. 3 and 4, each fastener assembly 30 includes a rectangular upper clamping plate 32, two bolts 36 each with a cooperating lower nut 38. The upper clamping plate 32 extends across and beyond the track plate 17 adjacent the rail flange 35 and has a projection 34 having a load bearing tapered surface overlying the flange 35 on the corresponding rail to hold it vertically and horizontally. Each clamping plate 32 has two elongated orifices 32*a*, one located at each longitudinal end thereof beyond the side of the track plate 17 through which the bolt 36 extends. The bolt 36 threadedly engages the lower nut 38. A gap 38*a* exists between the upper clamping plate 32 and the lower nut 38 to allow tightening across the two members. Nut 38 is provided with serrations 40 along one edge and has a threaded opening 42 into which the bolt 36 is threaded. Serrations 40 engage in a meshing relationship with the serrations 25 on an edge of the plate 21. Beneath the serrations 40 on each nut 38 is a perpendicular projection 44 which fits the underside of the lip 24 of rigid plate 21. This arrangement allows for rotation of each clamping plate 32 relative to the track plate 17 yet maintaining the interfacing of the load bearing tapered surface on the flange 35.

Returning to FIG. 2, one can see a top view of how the rail fastener 16 is suitable to clamp rails at various spacings and at various angles to the longitudinal axis of the rail fastener 16. Located between the support structure 26 (not shown) and the track plate 17 for each rail 15*a*, 15*b* is the fastener pad 20 of which the serrated sides 25 of the rigid member 21 are shown extending beyond the sides of the plate 17. Each pad 20 is oriented square to the plate 17. The flange 35 of the rails 15*a*, 15*b* are clamped to the track plate 17 by fastening the clamping plates 32 to the elastomeric member 20. The clamping plates 32 are oriented parallel to the flange 35 of the rails 15*a*, 15*b*. For rail 15*b*, extending perpendicular to the track plate 17, the clamping plates 32 are accordingly perpendicular to the track plate 17. Bolts 36 extending through the elongated orifices 32*a* to threadingly engage the nut 38. When the bolt is tightened, the rail 15*b* becomes securely clamped in place to the track plate 17. The distance between the two bolts 36 is shortest when the clamping plate 32 is perpendicular to the track plate 17. As shown in FIG. 3 and in conjunction with the foregoing description, each pad 20 can be laterally positioned along the longitudinal axis of its respective track 15*a*, 15*b* by suitably positioning the clamping plate 32, bolts 36 and the nut 38 such that the serrations of the nut 38 and rigid member 21 align.

Rail 15*a* is not parallel to rail 15*b* but extends at about an angle of 10° therefrom. As with rail 15*b*, the clamping plates 32 are oriented parallel to the flanges of rail 15*a*, thereby at an angle of about 10° from the plane perpendicular to the track plate 17. Such an angular orientation results in an increase in distance between the bolts for each clamping plate 32. The elongated orifices 32*a* allow for the increased distance. Bolts 36 are then extended through the orifices 32*a* and threadingly engaged with a corresponding nut 38. The serrations 40 and projection 44 of the nut 38 remain square with the respective serrations 25 and lip 21*a* of the fastener pad 20. Rail 15*a* can be clamped by tightening the bolt 36 accordingly.

A feature of the present invention is having fastener pad 20 that may be positioned underneath each special rail to result in maximum benefit of the resilient member 23 in isolating and damping vibratory motions of the rail. Each fastener pad 20 is positioned underneath the top rigid plate 17 by mating the extending pins 22*a*, 22*b* of each pad 20 with two of the series of the mating orifices 19 of the track plate 17. Once the location of the rail 15*a* on the track plate 17 has been determined, the fastener pad 20 may be joined to the top plate 17 so that the resilient member 23 of the fastener pad 20 is positioned between the rail 15*a* and the support structure 26. Furthermore, when replacement of the fastener pad 20 is required, the member 20 can be removed from the track plate 17 and easily replaced. The entire special trackwork fastener of prior art had to be completely removed and replaced upon replacement of the elastomeric pad. Also, the rail fastener 16 of the present invention is easily manufactured requiring only one mold for the fastener pad 20, regardless of the spacing or angle of the rails to the fastener. In manufacturing the prior art special trackwork fastener the entire assembly was molded with the rubber member. In the present invention, the top plate is separately manufactured and only the smaller elastomeric pad 20 requires molding. Furthermore, the number of serrations are greatly reduced, providing more advantages.

Figure 5:
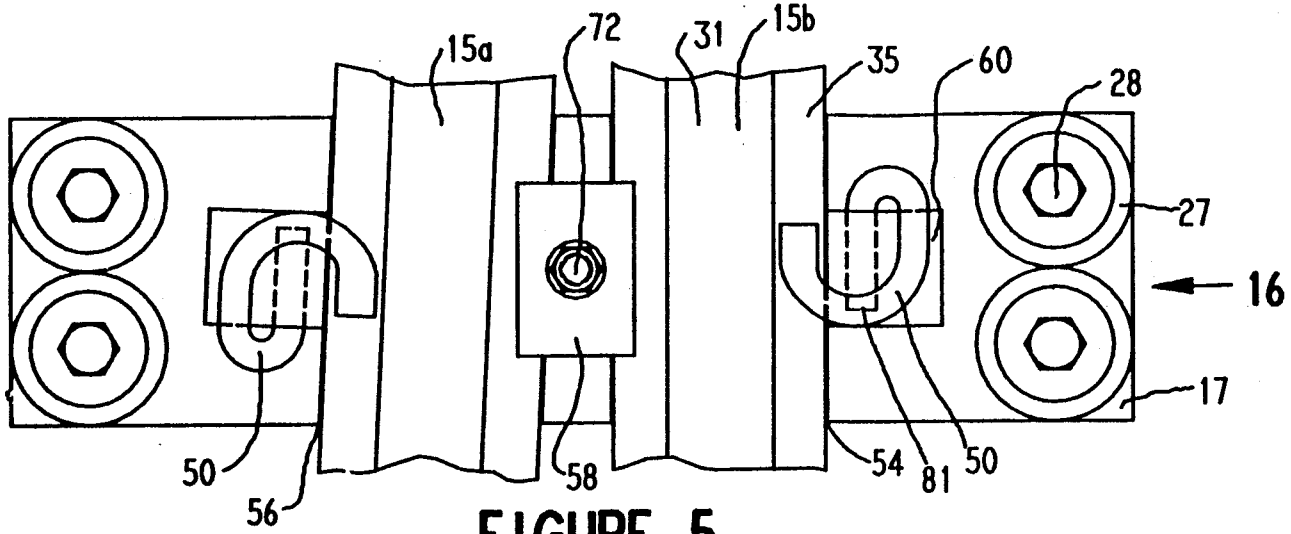
FIG. 5 is a top view of another embodiment of the present invention showing the track plate having a channel into which the base of the rail is placed and fastened by a clip.
Figure 6:
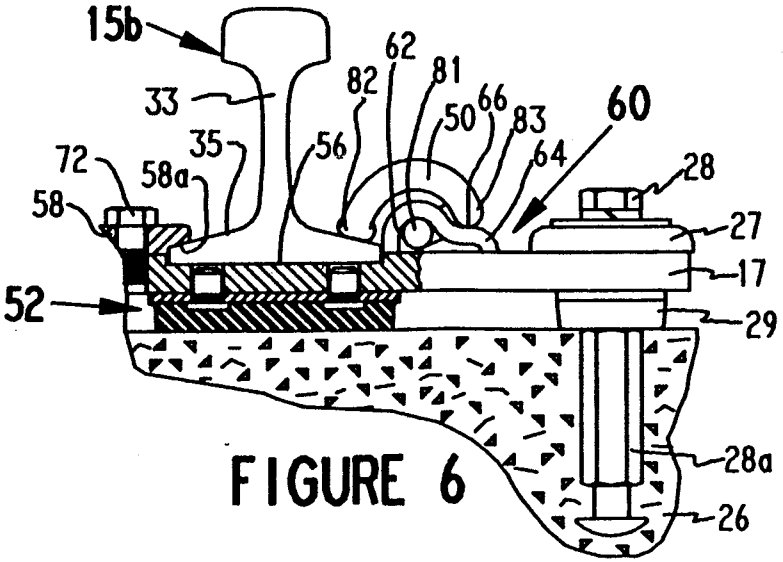
FIG. 6 is a partial end view of the embodiment shown in FIG. 5 showing a fastener disposed underneath the rail and the base of the rail disposed into the channel in the track plate.

In FIGS. 5 and 6, another embodiment of the invention is shown wherein elements corresponding to those of FIGS. 2 to 4 are identified by like reference numerals. In this embodiment, the rails 15*a* and 15*b* are clamped to the rail fastener 16 by resilient clips 50 and the fastener pads 52 do not have the serrated extensions as in the first embodiment. In particular, the flange portion 35 of each of the rails 15*a*, 15*b* are disposed in a mating channel 54, 56 cut into and extending across the top surface of the top plate 17. The channel 54 is disposed substantially perpendicular to the longitudinal length of the track plate 17 whereas channel 56 is disposed at a suitable angle to the longitudinal length of the track plate 17 to accommodate rail 15*b*. Rails 15*a*, 15*b* are removably secured to the track plate 17 by resilient clips 50 such as a Pandrol clip, which in turn are held in place by an arch 60 integrally formed with the top plate 17; and an intermediate clamp 58 disposed between the adjacent flanges 35. Each arch 60 has an inward flank 62 adjacent to the channel 56 and an outward flank 64 distanced from the channel 56, less steep than inward flank 62. Immediately adjacent to the outward flank 64 is a load bearing surface 66. The flange 35 of the rail 15*a*, 15*b* is secured within the respective channel 56, 54 by the resilient clip 50 driven into place. As shown in FIG. 5, a straight section 81 of clip 30 is inserted between the inward flank 62 and the upper surface of track plate 17. First and second load bearing sections 82, 83 of clip 50 contact the flange 35 of rail 15*a*, 15*b* and the bearing surface 66 of arch 60, respectively. The first bearing section 82 of clip 50 securely holds rail 15*a*, 15*b* in place on track plate 17 and the second bearing section 83 contacts the bearing surface 66 of arch 60.

The intermediate clamp 58 overlies adjacent flanges 35 of the rails 15*a*, 15*b* holding the rails vertically and horizontally. Clamp 58 is fastened to the top plate 17 by a threaded bolt 72 which passes through the clamp 58 and is threadedly engaged with a threaded orifice in the top plate 17. The clamp 58 has a tapered portion 58*a* on each side thereof suitable to engage the flange 35 of the respective rails 15*a*, 15*b*. Disposed on the opposite side of the top plate 17 beneath the channel 56 is a elastomeric member 74 similar to that described in the first embodiment excepting serrated edges.

As shown in FIG. 5, special trackwork may be removably secured by a combination of clip type fasteners and intermediate clamps. Angular orientation of a rail is accommodated by the bearing surface 82 of the clip 31 and the tapered portions 58*a* of the intermediate clamp 58.

While the invention has been described with reference to two embodiments, it will be understood by those skilled in the art that various changes may be made and equivalents may be substituted for elements thereof without departing from the scope of the invention. In addition, many modifications may be made to adapt a particular situation or material to the teaching of the invention without departing from the essential scope thereof. Therefore, it is intended that the invention not be limited to the particular embodiment disclosed as the best mode contemplated for carrying out this invention, but that the invention will include all embodiments falling within the scope of the claims.

I claim as my invention:

1. A rail fastener for fastening two closely spaced rails to a support structure comprising:

a rigid elongated track plate having a longitudinal axis for spanning and attachment to said rails, said track plate being disposed intermediate of said rails and said support structure;

a fastener pad interposed between said track plate and said support structure for each rail for isolating and damping vibration of each rail comprising a rigid member pad, a resilient member bonded to said rigid member, and means to secure said fastener pad to said track plate and to provide lateral adjustment of said fastener pad along said longitudinal axis of track plate; and a lateral and angular adjustable securing means to secure each rail to said track plate wherein the longitudinal direction of the rail may be orthogonal to said longitudinal axis of the track plate.

2. The rail fastener of claim 1 wherein said rigid member has vertical serrations extending along the longitudinal edges thereof and said means to secure said rails to said track plate comprises a threaded nut having serrations thereon engagable with said serrations extending along the longitudinal edges of said rigid member whereby said nut may adjustably engage the serrations along the length of the rigid member, a clamping member overlying said nut and engagable with an associated rail, and bolt means threaded into said nut for securing the clamping member to the nut while securing a rail against horizontal movement.

3. The rail fastener of claim 2 wherein said clamping member is rotatable about said nut for securing a rail to said track plate at any angular relationship with respect to the longitudinal length of the track plate.

4. The rail fastener of claim 1 wherein said track plate has orifices therethrough and said means to secure said resilient member to said track plate is a plurality of pins extending from said resilient member and mateable with said orifices.

5. The rail fastener of claim 1 wherein said track plate has an arch extending upward therefrom and said means to secure said rail to said track plate is a clip interconnecting said arch and said rail.

6. A rail fastener for fastening two closely spaced rails to a support structure comprising:

a rigid track plate for spanning and attachment to said rails and being disposed overlaying said support structure; a fastener pad connected to said rigid track plate for supporting said track plate upon said support structure comprising, a rigid member, a resilient member affixed to said rigid member and interposed between said rigid member and said support structure for isolating and damping vibrations of each rail, and an adjustable fastening means for securing said fastener pad to said track plate;

a means to secure said rails to said track plate;

and a means to secure said track plate to said support structure; wherein said rail fastener fastens closely spaced rails to the support structure securing the rails from lateral and longitudinal movement.

7. The rail fastener of claim 6 wherein said track plate has a plurality of orifices therethrough and said adjustable fastening means for securing said fastener pad to said track plate includes a plurality of pins extending from said fastener pad mateable with some of said plurality of orifices of said track plate.

8. The rail fastener of claim 6 wherein said track plate has an arch extending upward therefrom and adjacent to said rail and said means to secure said rail to said track plate is a clip interconnecting said arch and said rail.

9. A rail fastener for fastening a plurality of rails to a support structure comprising:

a rigid track plate for attachment to said rails being disposed overlaying said support structure;

a plurality of fastener pads longitudinally spaced along said track plate, each of said plurality of fastener pads comprising a rigid member, a resilient member affixed by means to said rigid member interposed between said rigid member and said support structure for supporting said track plate from said support structure, and a means to adjustably join said fastener pad to said track plate, wherein said rail fastener fastens at least two closely spaced rails to the support structure.

10. The rail fastener of claim 9 wherein said rigid member has serrations extending along the longitudinal edges thereof and said means to secure said rails to said track plate comprise a threaded nut having serrations thereon engagable with serrations extending along the longitudinal edge of said rigid member whereby said nut may adjustably engage said serrations along the length of the rigid member, a clamping member overlying said nut and engagable with an associated rail, and bolt means threaded into said nut for securing the clamping member to the nut while securing a rail against horizontal movement.

11. The rail fastener of claim 10 wherein said clamping member is rotatable about said nut for securing a rail to said track plate at any angular relationship with respect to the longitudinal length of the track plate.

12. The rail fastener of claim 9 wherein said track plate has a plurality of orifices therethrough and said means to adjustably join said fastener pad to said track plate includes a plurality of pins extending therefrom mateable with some of said plurality of orifices of said track plate.

13. The rail fastener of claim 9 wherein said track plate has an arch extending upward therefrom adjacent to said rail and said means to secure said rail to said track plate is a clip interconnecting said arch and said rail.

14. The rail fastener of claim 13 wherein said means to secure said rail to said track plate further includes a clamping member engagable with two rails and a bolt means threaded into said track plate for secruing the clamping member and securing the rail against horizontal movement.

15. A method for fastening of special rails to a support structure comprising the steps of:

providing a rigid elongated track plate for attachment to said rails; supporting said rigid elongated track plate from said support structure with a fastener pad assembly which includes a rigid member which contacts said track plate, a resilient member which is affixed to said rigid member between said rigid member and said support structure for isolating and damping vibrations of the rail:

attaching said fastener pad to said track plate in one of a plurality of selectable positions along said track plate; securing said rails to said track plate; and securing said track plate to said support structure.

16. A rail fastener for fastening a plurality of special rails to a support structure, each rail extending along a longitudinal length comprising a rigid track plate for attachment to each of said plurality of special rails, a plurality of fastener pads laterally spaced along said longitudinal axis of said track plate, each of said plurality of fastener pads comprising a rigid member, a resilient member affixed by means to said rigid member and a means to join said fastener pads to said track plate and serrations extending along the longitudinal edges of each of said plurality of fastener pads; and fastener assemblies for securing said rails to said track plate, said fastener assemblies each comprising a threaded nut having serrations thereon engagable with said serrations extending along the longitudinal edges of said fastener pad whereby said nut may engage the serrations at substantially any point along the longitudinal length of said fastener pad, a clamping member overlying said nut and engagable with an associated rail, and bolt means threaded into said nut for securing the clamping member to the nut while securing a rail to said track plate, wherein said rail fastener fastens closely spaced rails to the support structure securing the rail from lateral and horizontal movement.

* * * * *